US010403485B2

(12) United States Patent
Giles et al.

(10) Patent No.: US 10,403,485 B2
(45) Date of Patent: Sep. 3, 2019

(54) ENCODING OF PRECURSOR ION BEAM TO AID PRODUCT ION ASSIGNMENT

(71) Applicant: Micromass UK Limited, Wilmslow (GB)

(72) Inventors: Kevin Giles, Stockport (GB); Martin Raymond Green, Bowdon (GB); Keith Richardson, High Peak (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 192 days.

(21) Appl. No.: 14/345,061

(22) PCT Filed: Sep. 17, 2012

(86) PCT No.: PCT/GB2012/052293
§ 371 (c)(1),
(2) Date: Mar. 14, 2014

(87) PCT Pub. No.: WO2013/038212
PCT Pub. Date: Mar. 21, 2013

(65) Prior Publication Data

US 2014/0346341 A1 Nov. 27, 2014

Related U.S. Application Data

(60) Provisional application No. 61/537,791, filed on Sep. 22, 2011.

(30) Foreign Application Priority Data

Sep. 16, 2011 (GB) ..... 1116065.2

(51) Int. Cl.
*H01J 49/00* (2006.01)
*H01J 49/14* (2006.01)
*H01J 49/26* (2006.01)

(52) U.S. Cl.
CPC ..... *H01J 49/0036* (2013.01); *H01J 49/0031* (2013.01); *H01J 49/0045* (2013.01); *H01J 49/14* (2013.01); *H01J 49/26* (2013.01)

(58) Field of Classification Search
CPC .... H01J 49/004; H01J 49/005; H01J 49/0036; H01J 49/0031; H01J 49/26; H01J 49/14; H01J 49/0045
See application file for complete search history.

(56) References Cited

U.S. PATENT DOCUMENTS 6,323,482 B1 11/2001 Clemmer et al.
6,586,727 B2 7/2003 Bateman et al.
(Continued)

FOREIGN PATENT DOCUMENTS

WO 03/094197 11/2003
WO 2008/116283 10/2008

OTHER PUBLICATIONS

Hoaglund-Hyzer et al., "*Mobility Labeling for Parallel CID of Ion Mixtures*", Anal. Chem., vol. 72, pp. 2737-2740, 2000.

*Primary Examiner* — Brooke Purinton

(57) ABSTRACT

A method of encoding a parent or precursor ion beam to aid product ion assignment is disclosed. According to an embodiment the energy of parent ions entering a collision cell is progressively increased. Different species of parent ions fragment at different collision energies. Fragment ion intensity profiles are matched with parent ion intensity profiles to correlate fragment ions with corresponding parent ions.

10 Claims, 1 Drawing Sheet

(56) References Cited

U.S. PATENT DOCUMENTS

| | | | | |
|---|---|---|---|---|
| 6,744,043 | B2 | 6/2004 | Loboda | |
| 7,034,292 | B1 * | 4/2006 | Whitehouse | H01J 49/004 250/281 |
| 7,351,957 | B2 * | 4/2008 | Bloomfield | H01J 49/063 250/281 |
| 7,718,957 | B2 | 5/2010 | Belov | |
| 7,772,549 | B2 | 8/2010 | Vachet et al. | |
| 2002/0063206 | A1 * | 5/2002 | Bateman | H01J 49/0045 250/281 |
| 2007/0102634 | A1 * | 5/2007 | Frey | H01J 49/0045 250/288 |
| 2010/0301205 | A1 * | 12/2010 | Thomson | H01J 49/0045 250/283 |
| 2012/0049056 | A1 | 3/2012 | Zabrouskov et al. | |
| 2013/0105682 | A1 | 5/2013 | Geromanos et al. | |

* cited by examiner

ENCODING OF PRECURSOR ION BEAM TO AID PRODUCT ION ASSIGNMENT

CROSS REFERENCE TO RELATED APPLICATIONS

This application is the National Stage of International Application No. PCT/GB2012/052293, filed 17 Sep. 2012, which claims priority from and the benefit of U.S. Provisional Patent Application Ser. No. 61/537,791 filed on 22 Sep. 2011 and United Kingdom Patent Application No. 1116065.2 filed on 16 Sep. 2011. The entire contents of these applications are incorporated herein by reference.

BACKGROUND OF THE PRESENT INVENTION

The present invention relates to a mass spectrometer and a method of mass spectrometry.

It is well known to those skilled in the art of mass spectrometer design that the analysis of complex mixtures, such as those found in proteomics, is especially challenging. Multiple approaches have been employed including Data Directed Analysis ("DDA") where ions of interest are determined using a survey scan. Parent or precursor ions of interest are then sequentially isolated and fragmented or reacted to generate product ion spectra. Both the product ion spectra and precursor ions are then used to identify components. However, such techniques suffer from the problem of low duty cycle since whilst the parent or precursor ions are individually isolated and analysed other parent or precursor ions are lost. Furthermore, these techniques tend to be biased towards ions of particular intensities.

An improvement over the DDA methodology is to use an approach known as Shotgun or $MS^E$ wherein an ion beam is rapidly switched between a non-product ion forming mode (i.e. low collision energy) and a product on forming mode (i.e. high collision energy). According to the known approach, product ions are assigned to precursor ions based upon one or more characteristics of their chromatographic elution profile. This known approach benefits from high duty cycle and unbiased data acquisition but can suffer from a lack of specificity as multiple precursor ions can co-elute.

The known Shotgun or $MS^E$ approach may be categorised as being a high duty cycle approach having reduced specificity in contrast to the known DDA approach which may be categorised as having high specificity but a low duty cycle.

It is desired to provide a method that has the benefit of high duty cycle and unbiased data acquisition but which also has an improved specificity compared with the known Shotgun or $MS^E$ approach.

SUMMARY OF THE INVENTION

According to an aspect of the present invention there is provided a method of mass spectrometry comprising:

generating a plurality of species of parent ions;

varying, increasing, decreasing or ramping a parameter between a plurality of different parameter values so that different species of parent ions are caused to have different intensity profiles as a function of the parameter value or as a function of time;

mass analysing at each parameter value any fragment or product ions which are derived from the parent ions; and correlating or assigning fragment or product ions with corresponding parent ions on the basis of the intensity profile of the fragment or product ions as a function of the parameter value or as a function of time and the intensity profiles of the parent ions as a function of the parameter value or as a function of time.

According to an aspect of the present invention there is provided a method of mass spectrometry comprising:

generating a plurality of species of parent ions;

varying, increasing, decreasing or ramping a parameter between a plurality of different parameter values so that different species of parent ions are caused to have different intensity profiles as a function of the parameter values or as a function of time;

mass analysing at each parameter value any fragment or product ions which are derived from the parent ions; and correlating or assigning first fragment or product ions with second different fragment or product ions on the basis of the intensity profile of the first fragment or product ions as a function of the parameter value or as a function of time and the intensity profile of the second fragment or product ions as a function of the parameter value or as a function of time.

The step of varying, increasing, decreasing or ramping the parameter between a plurality of different parameter values preferably comprises varying, increasing, decreasing or ramping the parameter between at least 2, 3, 4, 5, 6, 7, 8, 9, 10, 15, 20, 25, 30, 35, 40, 45, 50, 55, 60, 65, 70, 75, 80, 85, 90, 95, 100, 110, 120, 130, 140, 150, 160, 170, 180, 190 or 200 different parameter values.

According to an embodiment the method further comprises transmitting the parent ions into a collision, fragmentation or reaction device and causing at least some of the ions to form fragment or product ions.

The parameter may comprise a collision energy of the parent ions.

The parameter may comprise either: (i) an ion-ion interaction or residence time; (ii) an ion-electron interaction or residence time; (iii) an ion-charged particle interaction or residence time; and (iv) an ion-neutral particle interaction or residence time.

The parameter may comprise a reagent ion concentration.

The parameter may comprise an energy or density of an electron beam or other beam of charged particles.

The parameter may comprise either: (i) mass or mass to charge ratio; (ii) a mass or mass to charge ratio transmission window; (iii) a mass or mass to charge ratio attenuation window; or (iv) a mass or mass to charge ratio ejection window.

The method preferably further comprises providing a mass filter.

The mass filter preferably comprises a quadrupole rod set mass filter or a mass filter comprising a plurality of electrodes wherein ions are confined in a first direction by a pseudo-potential well and in a second direction by a DC potential well.

The method preferably further comprises scanning, varying, increasing or decreasing a mass to charge ratio transmission window of the mass filter.

The method preferably further comprises operating the mass filter either in a: (i) low pass mode of operation wherein ions having mass to charge ratios less than a first mass to charge ratio value are transmitted; (ii) a band pass mode of operation wherein ions having mass to charge ratios greater than a first mass to charge ratio and less than a second mass to charge ratio are transmitted; or (iii) a high pass mode of operation wherein ions having mass to charge ratios greater than a first mass to charge ratio are transmitted.

The method preferably further comprises providing an on guide.

The ion guide preferably comprises a quadrupole or multipole rod set ion guide or an ion guide comprising a plurality of electrodes wherein ions are confined in a first direction by a pseudo-potential well and in a second direction by a DC potential well.

The method preferably further comprises applying one or more excitation waveforms to the ion guide wherein ions having a certain mass to charge ratio or mass to charge ratios within a certain range are excited and/or attenuated.

The method preferably further comprises scanning, varying, increasing or decreasing the frequency and/or amplitude of the one or more excitation waveforms.

The method preferably further comprises providing a mass or mass to charge ratio selective ion trap.

The ion trap preferably comprises a 2D or linear ion trap, a 3D ion trap comprising a central ring electrode and two end cap electrodes or an ion trap comprising a plurality of electrodes wherein ions are confined in a first direction by a pseudo-potential well, and in a second direction by a DC potential well.

The method preferably further comprises scanning a mass or mass to charge ratio ejection window of the ion trap wherein ions having masses or mass to charge ratios within the mass or mass to charge ratio ejection window are ejected or excited from the ion trap or otherwise emerge from the ion trap.

The parameter may comprise ionisation energy, ionisation efficiency, internal energy, spatial position, shift reagent composition, composition and/or polarisability of a reagent, collision, ion mobility separation or other gas, temperature, pressure or laser intensity.

The step of varying, increasing, decreasing or ramping the parameter may directly result in the formation of the fragment or product ions.

Alternatively, the step of varying, increasing, decreasing or ramping the parameter does not by itself directly result in the formation of the fragment or product ions.

According to an embodiment after varying, increasing, decreasing or ramping the parameter to vary, increase, decrease or ramp the intensity of at least some of the parent ions, the parent ions are then transmitted to a collision, fragmentation or reaction device wherein at least some of the parent ions are caused to form fragment or product ions.

An initial concentration of the parent ions preferably remains substantially constant whilst varying, increasing, decreasing or ramping the parameter between a plurality of different parameter values.

According to an aspect of the present invention there is provided a method of mass spectrometry comprising:

generating a plurality of species of parent ions;

causing different species of parent ions to adopt different spatial locations at an instance in time;

mass analysing fragment or product ions which are derived from the parent ions; and correlating or assigning fragment or product ions with corresponding parent ions on the basis of the spatial position of the fragment or product ions and the spatial position of the parent ions.

According to an aspect of the present invention there is provided a method of mass spectrometry comprising:

generating a plurality of species of parent ions;

causing different species of parent ions to adopt different spatial locations at an instance in time;

mass analysing fragment or product ions which are derived from the parent ions; and correlating or assigning first fragment or product ions with corresponding second different fragment or product ions on the basis of the spatial position of the first fragment or product ions and the spatial position of the second fragment or product ions.

The method preferably further comprises fragmenting or reacting the spatially dispersed parent ions to form fragment or product ions.

The step of causing different species of parent ions to adopt different spatial locations at an instance in time preferably comprises separating the parent ions on the basis of ion mobility or differential ion mobility.

The method preferably further comprises correlating or assigning fragment or product ions with parent ions or other fragment or product ions by filtering, peak detecting, hierarchical clustering, partitional clustering, K-means clustering, autocorrelation, probabilistic or Bayesian analysis or Principle Component Analysis ("PCA").

According to an aspect of the present invention there is provided a mass spectrometer comprising:

an ion source arranged and adapted to generate a plurality of species of parent ions;

a device arranged and adapted to vary, increase, decrease or ramp a parameter between a plurality of different parameter values so that different species of parent ions are caused to have different intensity profiles as a function of the parameter value or as a function of time;

a mass analyser arranged and adapted at each parameter value to mass analyse any fragment or product ions which are derived from the parent ions; and a device arranged and adapted to correlate or assign fragment or product ions with corresponding parent ions on the basis of the intensity profile of the fragment or product ions as a function of the parameter value or as a function of time and the intensity profiles of the parent ions as a function of the parameter value or as a function of time.

According to an aspect of the present invention there is provided a mass spectrometer comprising:

an ion source arranged and adapted to generate a plurality of species of parent ions;

a device arranged and adapted to vary, increase, decrease or ramp a parameter between a plurality of different parameter values so that different species of parent ions are caused to have different intensity profiles as a function of the parameter value or as a function of time;

a mass analyser arranged and adapted at each parameter value to mass analyse any fragment or product ions which are derived from the parent ions; and a device arranged and adapted to correlate or assign first fragment or product ions with second fragment or product ions on the basis of the intensity profile of the first fragment or product ions as a function of the parameter value or as a function of time and the intensity profile of the second fragment or product ions as a function of the parameter value or as a function of time.

The device arranged and adapted to vary, increase, decrease or ramp the parameter between a plurality of different parameter values is preferably arranged and adapted to vary, increase, decrease or ramp the parameter between at least 2, 3, 4, 5, 6, 7, 8, 9, 10, 15, 20, 25, 30, 35, 40, 45, 50, 55, 60, 65, 70, 75, 80, 85, 90, 95, 100, 110, 120, 130, 140, 150, 160, 170, 180, 190 or 200 different parameter values.

The mass spectrometer preferably further comprises a collision, fragmentation or reaction device for causing the parent ions to fragment to form fragment or product ions.

The parameter may comprise: (i) a collision energy of the parent ions; (ii) an ion-ion interaction or residence time; (iii) an ion-electron interaction or residence time; (iv) an ion-charged particle interaction or residence time; (v) an ion-neutral particle interaction or residence time; (vi) a reagent ion concentration; (vii) an energy or density of an electron beam or other beam of charged particles; (viii) mass or mass to charge ratio; (ix) a mass or mass to charge ratio transmission window; (x) a mass or mass to charge ratio attenuation window; (xi) a mass or mass to charge ratio ejection window; (xii) ionisation energy; (xiii) ionisation efficiency; (xiv) internal energy; (xv) spatial position; (xvi) shift reagent composition; (xvii) composition and/or polarisability of a reagent, collision, ion mobility separation or other gas; (xviii) temperature; (xix) pressure; or (xx) laser intensity.

The mass spectrometer preferably further comprises a mass filter.

The mass filter preferably comprises a quadrupole rod set mass filter or a mass filter comprising a plurality of electrodes wherein ions are confined in a first direction by a pseudo-potential well and in a second direction by a DC potential well.

The device arranged and adapted to vary, increase, decrease or ramp the parameter between a plurality of different parameter values is preferably arranged and adapted to scan, vary, increase or decrease a mass to charge ratio transmission window of the mass filter.

The mass filter is preferably operated either in a: (i) low pass mode of operation wherein ions having mass to charge ratios less than a first mass to charge ratio value are transmitted; (ii) a band pass mode of operation wherein ions having mass to charge ratios greater than a first mass to charge ratio and less than a second mass to charge ratio are transmitted; or (iii) a high pass mode of operation wherein ions having mass to charge ratios greater than a first mass to charge ratio are transmitted.

The mass spectrometer preferably further comprises an ion guide.

The device arranged and adapted to vary, increase, decrease or ramp the parameter between a plurality of different parameter values is preferably arranged and adapted to apply one or more excitation waveforms to the ion guide wherein ions having a certain mass to charge ratio or mass to charge ratios within a certain range are excited and/or attenuated.

The ion guide preferably comprises a quadrupole or multipole rod set ion guide or an ion guide comprising a plurality of electrodes wherein ions are confined in a first direction by a pseudo-potential well and in a second direction by a DC potential well.

The device arranged and adapted to vary, increase, decrease or ramp the parameter between a plurality of different parameter values is preferably arranged and adapted to scan, vary, increase or decrease the frequency and/or amplitude of the one or more excitation waveforms.

The mass spectrometer preferably comprises a mass or mass to charge ratio selective ion trap.

The device arranged and adapted to vary, increase, decrease or ramp the parameter between a plurality of different parameter values is preferably arranged and adapted to scan a mass or mass to charge ratio ejection window of the ion trap wherein ions having masses or mass to charge ratios within the mass or mass to charge ratio ejection window are ejected or excited from the ion trap or otherwise emerge from the on trap.

The ion trap preferably comprises a 2D or linear ion trap, a 3D on trap comprising a central ring electrode and two end cap electrodes or an ion trap comprising a plurality of electrodes wherein ions are confined in a first direction by a pseudo-potential well and in a second direction by a DC potential well.

According to an aspect of the present invention there is provided a mass spectrometer comprising:

an ion source arranged to generate a plurality of species of parent ions;

a device arranged and adapted to cause different species of parent ions to adopt different spatial locations at an instance in time;

a mass analyser arranged and adapted to mass analyse fragment or product ions which are derived from the parent ions; and a device arranged and adapted to correlate or assign fragment or product ions with corresponding parent ions on the basis of the spatial position of the fragment or product ions and the spatial position of the parent ions.

According to an aspect of the present invention there is provided a mass spectrometer comprising:

an ion source arranged to generate a plurality of species of parent ions;

a device arranged and adapted to cause different species of parent ions to adopt different spatial locations at an instance in time;

a mass analyser arranged and adapted to mass analyse fragment or product ions which are derived from the parent ions; and a device arranged and adapted to correlate or assign first fragment or product ions with corresponding second different fragment or product ions on the basis of the spatial position of the first fragment or product ions and the spatial position of the second fragment or product ions.

According to an aspect of the present invention there is provided a method of mass spectrometry comprising:

generating a plurality of species of parent ions;

causing different species of parent ions to assume a first distribution as a function of a first parameter and then causing the parent ions which have assumed the first distribution to assume a second different distribution as a function of a second parameter, wherein the second distribution preferably depends on the first distribution;

mass analysing fragment or product ions which are derived from the parent ions which have assumed the second distribution; and correlating or assigning fragment or product ions with corresponding parent ions on the basis of the distribution of the fragment or product ions according to the second parameter and the distribution of the parent ions according to the second parameter.

According to an aspect of the present invention there is provided a method of mass spectrometry comprising:

generating a plurality of species of parent ions;

causing different species of parent ions to assume a first distribution as a function of a first parameter and then causing the parent ions which have assumed the first distribution to assume a second different distribution as a function of a second parameter, wherein the second distribution preferably depends on the first distribution;

mass analysing fragment or product ions which are derived from the parent ions which have assumed the second distribution; and correlating or assigning first fragment or product ions with corresponding second different fragment or product ions on the basis of the distribution of the first fragment or product ions according to the second parameter and the distribution of the second fragment or product ions according to the second parameter.

The method preferably further comprises fragmenting or reacting the parent ions which have assumed the second distribution.

The first parameter and/or the second parameter preferably comprise time, position or energy.

The shape of the first distribution and/or the shape of the second distribution preferably depend upon ion mobility, differential ion mobility, mass, mass to charge ratio or another physico-chemical property.

According to an aspect of the present invention there is provided a mass spectrometer comprising:

an ion source arranged and adapted to generate a plurality of species of parent ions;

a device arranged and adapted to cause different species of parent ions to assume a first distribution as a function of a first parameter and then to cause the parent ions which have assumed the first distribution to assume a second different distribution as a function of a second parameter, wherein the second distribution preferably depends on the first distribution;

a mass analyser arranged and adapted to mass analyse fragment or product ions which are derived from the parent ions which have assumed the second distribution; and a device arranged and adapted to correlate or assign fragment or product ions with corresponding parent ions on the basis of the distribution of the fragment or product ions according to the second parameter and the distribution of the parent ions according to the second parameter.

According to an aspect of the present invention there is provided a mass spectrometer comprising:

an ion source arranged and adapted to generate a plurality of species of parent ions;

a device arranged and adapted to cause different species of parent ions to assume a first distribution as a function of a first parameter and then to cause the parent ions which have assumed the first distribution to assume a second different distribution as a function of a second parameter, wherein the second distribution preferably depends on the first distribution;

a mass analyser arranged and adapted to mass analyse fragment or product ions which are derived from the parent ions which have assumed the second distribution; and a device arranged and adapted to correlate or assign first fragment or product ions with corresponding second fragment or product ions on the basis of the distribution of the first fragment or product ions according to the second parameter and the distribution of the second fragment or product ions according to the second parameter.

According to an aspect of the present invention there is provided a method of mass spectrometry comprising:

generating a plurality of species of parent ions;

varying the intensity profile of one or more species of the parent ions so that different species of parent ions have different intensity profiles as a function of time;

mass analysing fragment ions which are derived from the parent ions; and correlating fragment ions with corresponding parent ions on the basis of the intensity profiles of the fragment ions and the intensity profiles of the parent ions.

The step of varying the intensity profile of the one or more species of parent ions preferably directly results in the formation of the fragment ions.

According to the preferred embodiment the step of varying the intensity profile of the one or more species of parent ions comprises varying the collision energy of parent ions entering a fragmentation device.

According to a less preferred embodiment the step of varying the intensity profile of the one or more species of parent ions may be independent from the subsequent formation of the fragment ions.

According to this embodiment once the intensity profile of the one or more species of parent ions has been varied then the parent ions are transmitted to a fragmentation device wherein the parent ions are caused to fragment.

According to an aspect of the present invention there is provided a method of mass spectrometry comprising:

generating a plurality of species of parent ions;

causing different species of parent ions to adopt different spatial locations at an instance in time;

subjecting the spatially dispersed parent ions to fragmentation;

mass analysing fragment ions which are derived from the parent ions; and correlating fragment ions with corresponding parent ions on the basis of the spatial position of the fragment ions and the spatial position of the parent ions.

The step of causing different species of parent ions to adopt different spatial locations at an instance in time further preferably comprises separating ions on the basis of ion mobility or differential ion mobility.

According to the preferred embodiment fragment ions are correlated with or assigned to parent ions by filtering, peak detection, hierarchical clustering, partitional clustering, K-means clustering, autocorrelation, probabilistic (Bayesian) analysis or Principle Component Analysis ("PCA").

According to an aspect of the present invention there is provided a method of mass spectrometry comprising:

generating a plurality of species of parent ions;

varying the intensity profile of one or more species of the parent ions so that different species of parent ions have different intensity profiles as a function of time;

mass analysing fragment ions which are derived from the parent ions; and correlating first fragment ions with second different fragment ions on the basis of the intensity profiles of the first fragment ions and the intensity profiles of the second fragment ions.

According to an aspect of the present invention there is provided a method of mass spectrometry comprising:

generating a plurality of species of parent ions;

causing different species of parent ions to adopt different spatial locations at an instance in time;

subjecting the spatially dispersed parent ions to fragmentation;

mass analysing fragment ions which are derived from the parent ions; and correlating first fragment ions with corresponding second different fragment ions on the basis of the spatial position of the first fragment ions and the spatial position of the second fragment ions.

According to an aspect of the present invention there is provided a mass spectrometer comprising:

an ion source arranged to generate a plurality of species of parent ions;

a device arranged and adapted to vary the intensity profile of one or more species of the parent ions so that different species of parent ions have different intensity profiles as a function of time;

a mass analyser arranged and adapted to fragment ions which are derived from the parent ions; and a device arranged and adapted to correlate fragment ions with corresponding parent ions on the basis of the intensity profiles of the fragment ions and the intensity profiles of the parent ions.

According to an aspect of the present invention there is provided a mass spectrometer comprising:

an ion source arranged to generate a plurality of species of parent ions;

a device arranged and adapted to cause different species of parent ions to adopt different spatial locations at an instance in time;

a fragmentation device arranged and adapted to fragment the spatially dispersed parent ions;

a mass analyser arranged and adapted to mass analyse fragment ions which are derived from the parent ions; and a device arranged and adapted to correlate fragment ions with corresponding parent ions on the basis of the spatial position of the fragment ions and the spatial position of the parent ions.

According to an aspect of the present invention there is provided a mass spectrometer comprising:

an ion source arranged to generate a plurality of species of parent ions;

a device arranged and adapted to vary the intensity profile of one or more species of the parent ions so that different species of parent ions have different intensity profiles as a function of time;

a mass analyser arranged and adapted to mass analyse fragment ions which are derived from the parent ions; and a device arranged and adapted to correlate first fragment ions with second different fragment ions on the basis of the intensity profiles of the first fragment ions and the intensity profiles of the second fragment ions.

According to an aspect of the present invention there is provided a mass spectrometer comprising:

an ion source arranged to generate a plurality of species of parent ions;

a device arranged and adapted to cause different species of parent ions to adopt different spatial locations at an instance in time;

a fragmentation device arranged and adapted to fragment the spatially dispersed parent ions;

a mass analyser arranged and adapted to mass analyse fragment ions which are derived from the parent ions; and a device arranged and adapted to correlate first fragment ions with corresponding second different fragment ions on the basis of the spatial position of the first fragment ions and the spatial position of the second fragment ions.

The preferred embodiment improves relationship between duty cycle and specificity for complex mixtures.

According to an aspect of the present invention there is provided an apparatus and method to encode, measure and characterize a precursor ion beam. The encoding device is preferably separate from the measurement device and allows product ions to retain their related precursor encoding and to be measured and/or characterized and be assigned to their related precursor.

In the present application the term "encoding" should be understood as encompassing the modulation of the intensity of the parent or precursor ions. The modulation can occur in time or space (or both) leading to time or space dependent precursor ion intensity. The encoding process may or may not include non-deterministic or pseudo random effects such as those produced by space charge or saturation. The encoding process preferably results in different precursor ions having different encoding i.e. different intensity profiles. The encoding of a particular precursor ion may be determined by the measurement of the precursor ion via a second device such as a Time of Flight mass spectrometer.

According to a preferred embodiment the encoding may be of a non-dispersive type as opposed to dispersive type encodings such as those described by Clemmer et. al. (Anal. Chem. 2000, 72, 2737-2740).

In non-dispersive type encodings according to the preferred embodiment the encoding device effectively acts as a filter and requires the variation or scanning of a particular parameter so as to encode the entire precursor ion population.

According to a less preferred embodiment parent ions may be subjected to dispersive type encoding such as a conventional ion mobility separator. According to this embodiment the encoding does not require the variation or scanning of a parameter. With a dispersive type of device the precursor ion beam separates naturally within the device under static conditions.

It is recognized that naturally dispersive encoding devices may additionally benefit from the scanning or variation of a particular parameter as well and such embodiments are also intended to fall within the intended scope of the present invention.

The preferred embodiment relates to encoding a precursor ion beam (e.g. causing the intensity of the ion beam to vary with time or causing the ion beam to separate spatially) so that the ion beam has a temporally or spatially varying profile.

According to one embodiment the encoding may include an unknown or pseudo-random component.

The form of the encoding may be determined by interrogation of precursor ion spectra.

After or during encoding, product or related ions are preferably formed and measured. A feature of the preferred embodiment is that the product or related ions preferably retain the encoding of the corresponding precursor ions. As a result, the product or related ions can be assigned to or correlated with precursor ions by virtue of the similarities of the encoding.

The approach according to the preferred embodiment is unbiased and possesses a high duty cycle, giving an improvement over Data Directed Analysis or targeted approaches.

The approach according to the preferred embodiment also represents an improvement over Shotgun, High-Low switching or $MS^E$ type approaches as the encoding process is preferably orthogonal to chromatographic encoding thereby leading to higher effective peak capacity.

The preferred embodiment involves encoding a precursor ion beam. The encoding may be achieved by scanning or varying a characteristic or component of an instrument or mass spectrometer and profiling the effects of the variation by acquiring multiple mass spectra over the course of the encoding process thus producing a nested data set. The encoding of each individual precursor ion may be determined by interrogation of the nested data set.

Product ions are preferably formed either after the encoding process or as a direct result of the encoding process. Multiple product ion mass spectra may be acquired over the course of the precursor encoding process and recorded as a nested data set. Product ions formed and acquired via this approach preferably retain the encoding of the associated precursor facilitating their assignment.

Assignment of product ions to precursor ions and/or identification of groups of related product ions may be performed using techniques that include, but are not limited to, filtering, peak detection, hierarchical clustering, partitional clustering, K-means clustering, autocorrelation, probabilistic (Bayesian) analysis and Principle Component Analysis ("PCA").

The encoding process according to the preferred embodiment is preferably inherently fast or may be required to be fast for nesting purposes. Therefore, to maintain the precursor encoding, the overall system may utilise relatively short transit times through high pressure regions necessitating use of axial fields, travelling wave devices or other similar devices that serve to propel ions through gas-filled devices.

The preferred embodiment relates to an improvement to existing apparatus, specifically quadrupole-Time of Flight ("Q-TOF") mass spectrometers and similar instruments.

It will be understood by those skilled in the at that a conventional Shotgun mode of operation wherein a collision cell is repeatedly switched ON and OFF is not intended to fall within the scope of the present invention. In such a mode of operation two different parent ions have essentially the same intensity profile as a function of time namely 100% then 0%. It will be understood by those skilled in the art that an important aspect of the preferred embodiment is that in contrast to conventional approaches two different parents ions will have substantially different intensity profiles as a function of time.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive on source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass filter, mass analyser or ion trap further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred embodiment of the present invention will now be described.

Figure 1:
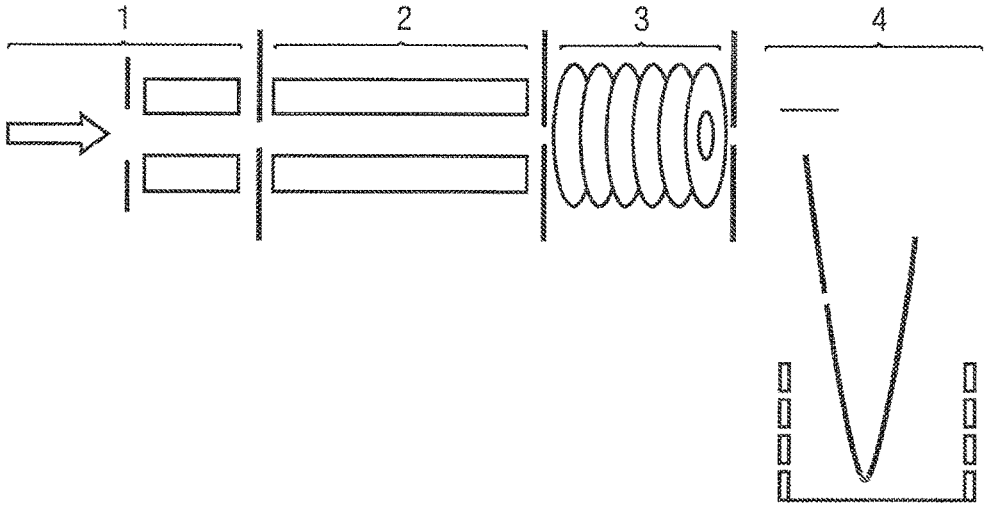
FIG. 1 shows a schematic diagram of mass spectrometer which may be used according to an embodiment of the present invention for fragmentation or collision energy encoding.

FIG. 1 shows a schematic diagram of a mass spectrometer according to an embodiment of the present invention. The mass spectrometer is arranged for fragmentation or collision energy encoding in accordance with an embodiment of the present invention.

Parent or precursor ions preferably pass from an ion source region 1 to a RF quadrupole rod set 2. The RF quadrupole rod set 2 mass is preferably operated in a broadband transmission mode i.e. in an ion guide only mode of operation. Parent or precursor ions are then preferably transmitted to a collision or fragmentation cell 3 which is preferably arranged downstream of the quadrupole rod set 2.

The collision or fragmentation cell 3 may comprise a plurality of electrodes having one or more apertures through which ions are transmitted in use. One or more transient DC voltages may be applied to the electrodes of the collision or fragmentation cell 3 in order to urge ions along the axial length of the collision or fragmentation cell 3.

According to an embodiment the energy of parent or precursor ions entering the collision or fragmentation cell 3 is preferably increased linearly from 4 eV to 60 eV in 0.25 eV steps. As the energy of the parent or precursor ions entering the collision or fragmentation cell 3 is progressively increased, then the parent or precursor ions will start to undergo fragmentation.

The optimum energy at which a particular species of parent or precursor ions fragments depends upon the specific characteristics of the parent or precursor ion concerned. As a result, different species of parent or precursor ions will fragment at different collision energies and hence at different times as the collision energy of parent or precursor ions is increased.

Ions which emerge from the collision or fragmentation cell 3 (which may comprise any unfragmented parent or precursor ions and any fragment ions which may have been formed) are then preferably transported to an orthogonal acceleration Time of Flight mass analyser 4 for subsequent mass analysis.

The ions which emerge from the collision or fragmentation cell 3 may pass through one or more travelling wave RF devices and/or one or more electrostatic lenses prior to being mass analysed in the orthogonal acceleration Time of Flight mass analyser.

The Time of Flight mass analyser 4 preferably operates on a significantly shorter timescale than the timescale over which the collision energy is being ramped. As a result, the orthogonal acceleration Time of Flight mass analyser effectively samples the collision energy space producing a full mass to charge ratio spectrum at each collision energy value.

Nested data is therefore preferably obtained and may be interrogated.

Figure 2:
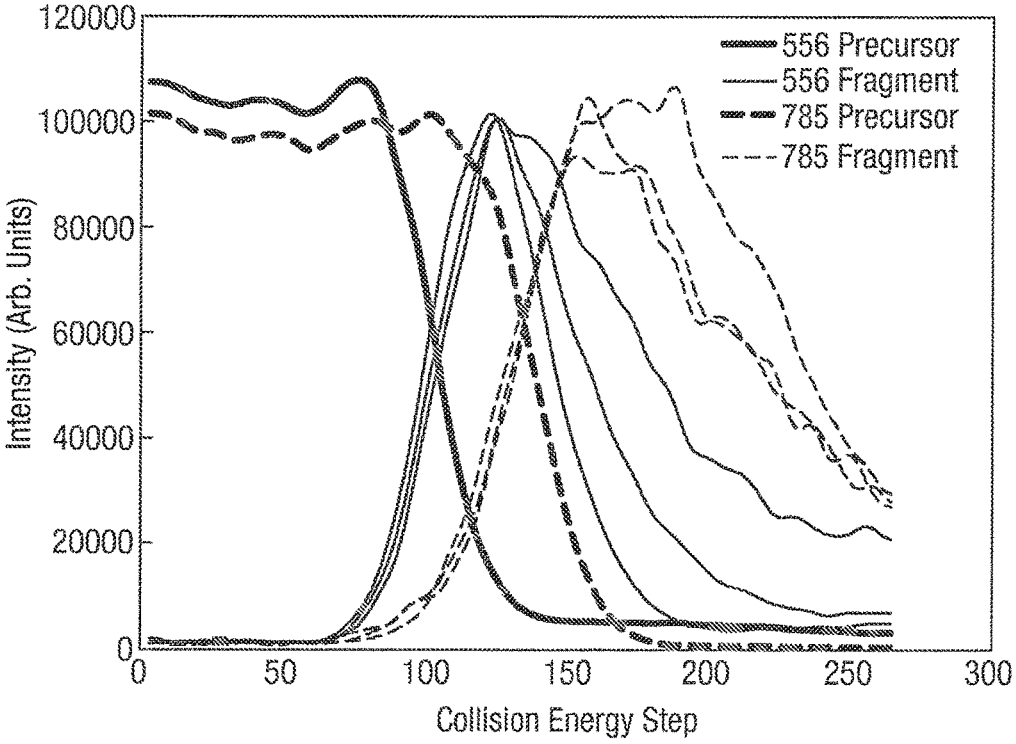
FIG. 2 shows the intensities of two parent ions and corresponding fragment ions as a function of collision energy according to a preferred embodiment of the present invention and shows how fragment ions may be correlated with parent ions on the basis of their intensity profile as a function of collision energy.

FIG. 2 illustrates an embodiment of the present invention wherein two different species of parent ions were transmitted to the collision or fragmentation cell 3 and the energy of the parent or precursor ions entering the collision or fragmentation cell 3 was progressively ramped or increased.

The two different species of parent ions comprised a mixture of Leucine Enkephalin ions (singly charged having a mass to charge ratio of 556) and Glu-fibrinopeptide ions (doubly charged having a mass to charge ratio of 785). The mixture of parent or precursor ions were then transmitted to the collision or fragmentation cell 3.

The intensities of the two parent or precursor ions is shown in FIG. 2 and is plotted as a function of the collision energy of the ions (and hence as a function of time). FIG. 2 also shows the intensity of two species of fragment ions which were formed as a function of the collision energy of the ions (and hence as a function of time) as a result of the mixture of two species of parent ions being subjected to fragmentation.

It can be seen from FIG. 2 that there is a correlation between the intensity and time of creation of fragment ions and the intensity profile of corresponding parent or precursor ions. In particular, it will be noted that as the intensity of a particular species of parent ions begins to decrease, then the intensity of corresponding related fragment ions correspondingly beings to increase.

FIG. 2 shows that for collision energies up to about 50 eV there is an inverse relationship between the intensity of parent ions as a function of time and the intensity of corresponding product or fragment ions derived from those parent ions as a function of time.

According to the preferred embodiment fragment ions are matched, assigned or otherwise correlated with a particular species of parent or precursor ions on the basis of the intensity profiles of both the parent ions and the fragment ions.

The embodiment described above comprises an embodiment wherein the formation of fragment or product ions by progressively increasing the collision energy of parent ions results in an encoding of the parent ions. The formation of fragment or parent ions is effectively inherent with the encoding process.

Other embodiments are contemplated wherein fragment or product ions may be created by other means including ion-ion reactions or other processes such as Electron Transfer Dissociation ("ETD"), Electron Capture Dissociation ("ECD") and Proton Transfer Reactions ("PTR"). According to these embodiment the reaction time or reagent concentration may be varied instead of varying the collision energy.

Further embodiments are also contemplated wherein fragment or product ions may be formed by ion-neutral reactions such as gas phase Hydrogen Deuterium Exchange ("HDX"), supercharging, charge reduction and Electron impact Dissociation ("EID") wherein the energy or density of the electron beam is varied. In addition many other product ion forming techniques such as Photo-Dissociation ("PD"), Surface Induced Dissociation ("SID"), RF heating based dissociation and thermal dissociation may be used to generate product or fragment ions.

In each case an operational parameter of a mass spectrometer is varied so as to affect the fragmentation efficiency or characteristic.

According to a particularly preferred embodiment a mass to charge ratio transmission window of a quadrupole rod set or other form of mass filter or the mass to charge ratio of ions ejected from a mass selective ion trap may be progressively or otherwise varied, scanned or ramped.

According to another preferred embodiment a quadrupole or other form of ion guide may be provided and one or more excitation waveforms may be applied to the ion guide. The ion guide preferably transmits substantially all ions received by the ion guide apart from ions having mass to charge ratios which correspond with the frequency/frequencies of the one or more excitation waveforms. Ions having mass to charge ratios which correspond with the frequency/frequencies of the one or more excitation waveforms are preferably excited or resonantly ejected and may impinge upon the electrodes forming the ion guide resulting in the substantial attenuation of those ions. The frequency and/or amplitude of the one or more excitation waveforms may be progressively or otherwise varied, scanned or ramped.

Other encoding approaches may also be utilised which do not intrinsically result in the generation of fragment or product ions. Such approaches are also intended to fall within the scope of the present invention. According to an embodiment parent ions may be fragmented or reacted in a downstream fragmentation or reaction device but the process of encoding the parent ions (i.e. by varying the intensity of the parent or precursor ions) does not, by itself, inherently generate product or fragment ions.

For example, according to an embodiment a downstream fragmentation or reaction device such as a CID or ETD cell may be provided. A parent or precursor ion beam may be encoded by varying a characteristic of the instrument such as the mass to charge ratio transmission profile. Such a method of encoding the parent ion beam does not inherently cause fragment or product ions to be generated. The encoded parent or precursor ion beam may then be switched between a product ion formation mode (e.g. wherein the parent or precursor beam is transmitted through the fragmentation or reaction device which is operated so as to cause fragmentation or reaction of the parent or precursor ions) and a non-product ion formation mode (e.g. wherein the parent or precursor beam either by-passes the fragmentation or reaction device or is transmitted through the fragmentation or reaction device which is operated in a mode of operation wherein parent ions are not substantially fragmented or reacted) to produce two nested data sets.

According to this embodiment the parent or precursor ion beam encoding can be characterised by interrogation of the non-product ion formation data set in a similar manner to that described above. Since the product or fragment ion formation occurs after the encoding process, the product or fragment ions retain the same encoding as the parent or precursor ions and may be assigned to the parent or precursor ions as a result of this.

According to the preferred embodiment the encoding process is preferably inherently fast for nesting purposes. Therefore, in order to maintain the parent or precursor encoding the overall system may utilise relatively short transit times through high pressure regions necessitating the use of axial fields, travelling wave devices or other similar devices that serve to propel ions through gas-filled devices.

The example described above relates to a mass to charge ratio based encoding embodiment. Mass to charge ratio based encoding can be implemented by known approaches such as time of flight, ion trap ejection methods including driving ions over pseudo-potential barriers, magnetic field deflection methods and mass to charge ratio transmission windows through quadrupoles. The latter includes RF/DC modes, RF only modes utilizing low mass to charge ratio cut off and resonant ejection via one or more resonant excitation windows (notches).

Other encoding mechanisms that do not, by themselves, intrinsically produce product ions may be utilised including changing ionization efficiency (including suppression effects), Differential ion Mobility ("DMS") or Field Asymmetric Ion Mobility Spectrometry ("FAIMS"), Differential Mobility Analysis ("DMA"), modification of ion mobility characteristics for DMS or ion Mobility Spectrometry ("IMS") by addition of shift reagents, changing the composition or polarity/polarisability of an IMS drift gas (for example by adding polar dopants), changing the internal energy of the ions to effect conformational changes, and using distillation profiles based on the boiling point or vapour pressure of components when temperature is varied. According to these embodiments parent or precursor ions are still fragmented but the encoding (i.e. variation in intensity) of the parent or precursor ions does not directly result in the generation of fragment or product ions.

Embodiments are contemplated wherein encoding methods may include a pseudo-random effect. For example, when scanning ions out of an ion trap, the relationship between ejected mass to charge ratio and time is a function of the amount of charge within the ion trap which results in the need for complicated automatic gain control algorithms. Using the approaches described above, the performance of the system as a whole becomes almost independent of these effects as the errors or shifts in the precursor ions are mirrored in the product ions.

The embodiments described above may be applied to a wide range of parent or precursor mass to charge ratios associated with Shotgun or $MS^E$ experiments. Encoding methods may also be applied to DDA based experiments where multiple parent or precursor ions are contained within the isolation window (some times called chimericy) facilitating the assignment of product ions to parent or precursor ions albeit over a narrower parent or precursor mass to charge ratio range.

Other embodiments are contemplated wherein the encoding may be used to associate multiple fragment ions from the same precursor with each other.

The determination of the encoding can yield useful analytical information such as mass to charge ratio or ion mobility.

Multiple encoding devices may be combined to give more specific multiple dimensional encoding of parent or precursor ions or encoding of later generation product ions.

The preferred device may be coupled to existing dispersive encoding devices such as chromatographic separators or ion mobility separators.

The preferred device need not be restricted to mass spectrometry systems. In principle other fast ion measuring systems can be used such as ion mobility.

According to an embodiment of the present invention some forms of encoding may be transient either by design or due to practical constraints. In such cases two or more encoding procedures may be chained together. For example, an ion beam may be encoded in a dimension X in a manner that a distribution Ps(X) is obtained for each species s. It is necessary that different species sometimes produce measurably different distributions. However, it may not be possible or desirable to observe these distributions directly for parent or precursor and/or fragment or product ions. In this case, it may be possible to utilise the X based encoding as the basis for encoding in a new dimension Y such that ions that are encoded with different values of X sometimes have measurably different distributions in Y: Px(Y). In this case, for species s, the final distribution in Y would depend both on Ps(X) and Px(Y). This indirect encoding may be preserved even when the initial separation in X is lost or discarded.

By way of example, it is known to use a Differential Mobility Analyser ("DMA") to spatially distribute an ion beam along an axis x. It is known to sample ions at a fixed position x (and therefore at fixed mobility) so that the device as a whole operates as a mobility filter. Alternatively, it is possible to sample ions at multiple x positions, but multiple analysers would then be required downstream of the device to maintain the mobility separation. However, if the ions are modulated predictably in a x and time (t) dependent manner as they leave the Differential Mobility Analyser, then they can be reformed into a single continuous beam and the mobility of a particular species can be reconstructed by examination of its temporal modulation. In this case the first (transient) encoding dimension is position (X=x) and the second is time (Y=t).

Accordingly, it is contemplated that parent ions may be arranged to assume a first distribution as a function of a first parameter such as time, position or energy. The parent ions may then be arranged to assume a second distribution as a function of a second parameter such as time, position or energy. For example, one kind of time dependence may be converted into a more convenient kind of time dependence. The parent ions are then fragmented or reacted and fragment ions are correlated with the parent ions on the basis of their respective distributions according to the second parameter.

In addition yet further embodiments are contemplated wherein the chain may be extended to include third and further distributions. For example, parent ions having assumed a second distribution may then be arranged to assume a third or further distribution according to a third or further parameter. The third of further distribution preferably depends upon the second distribution.

Yet further embodiments are contemplated wherein the distributions may be multi-dimensional i.e. functions of more than one parameter. For example, the initial distribution might be in two position coordinates X and Y which is then converted into a one dimensional encoding in time using a series of masks.

Although the present invention has been described with reference to the preferred embodiments, it will be understood by those skilled in the art that various changes in form and detail may be made without departing from the scope of the invention as set forth in the accompanying claims.

The invention claimed is:

1. A method of mass spectrometry comprising:

generating a plurality of species of parent ions to form a precursor ion beam;

encoding said precursor ion beam by varying a parameter between a plurality of different parameter values so that different species of parent ions are caused to have different intensity profiles as a function of said parameter value or as a function of time, wherein the step of varying said parameter between a plurality of different parameter values comprises varying said parameter between at least 3 different parameter values;

determining said encoding by measuring the precursor ions and interrogating precursor ion spectra;

mass analysing at each parameter value any product ions which are derived from said parent ions; and correlating or assigning product ions with corresponding parent ions based on the intensity profile of said product ions as a function of said parameter value or as a function of time and the intensity profiles of said parent ions as a function of said parameter value or as a function of time, wherein said parameter comprises: (i) a collision energy of said parent ions; (ii) an ion-ion interaction or residence time; (iii) an ion-electron interaction or residence time; (iv) an ion-charged particle interaction or residence time; (v) an ion-neutral particle interaction or residence time; (vi) a reagent ion concentration; or (vii) an energy or density of an electron beam or other beam of charged particles.

2. A method as claimed in claim 1, wherein the step of varying said parameter between a plurality of different parameter values comprises varying said parameter between at least 4, 5, 6, 7, 8, 9, 10, 15, 20, 25, 30, 35, 40, 45, 50, 55, 60, 65, 70, 75, 80, 85, 90, 95, 100, 110, 120, 130, 140, 150, 160, 170, 180, 190 or 200 different parameter values.

3. A method as claimed in claim 1, further comprising transmitting said parent ions into a collision, fragmentation or reaction device and causing at least some of said ions to form product ions.

4. A method as claimed in claim 1, wherein after varying said parameter to vary the intensity of at least some of said parent ions, said parent ions are then transmitted to a collision, fragmentation or reaction device wherein at least some of said parent ions are caused to form product ions.

5. A method as claimed in claim 1, wherein an initial concentration of said parent ions remains substantially constant whilst varying said parameter between a plurality of different parameter values.

6. A method as claimed in claim 1, wherein said parameter comprises the collision energy of said parent ions and the intensity profile of said product ions is a function of the collisional energy of said parent ions.

7. A method as claimed in claim 1, wherein said parameter comprises: (i) an ion-ion interaction or residence time; (ii) an ion-electron interaction or residence time; (iii) an ion-charged particle interaction or residence time; (iv) an ion-neutral particle interaction or residence time; (v) a reagent ion concentration; or (vi) an energy or density of an electron beam or other beam of charged particles.

8. A method of mass spectrometry comprising:

generating a plurality of species of parent ions to form a precursor ion beam;

encoding said precursor ion beam by varying a parameter between a plurality of different parameter values so that different species of parent ions are caused to have different intensity profiles as a function of said parameter value or as a function of time, wherein the step of varying said parameter between a plurality of different parameter values comprises varying said parameter between at least 3 different parameter values;

determining said encoding by measuring the precursor ions and interrogating precursor ion spectra;

mass analysing at each parameter value any product ions which are derived from said parent ions; and correlating or assigning first product ions with second different product ions based on the intensity profile of said first product ions as a function of said parameter value or as a function of time and the intensity profile of said second product ions as a function of said parameter value or as a function of time, wherein said parameter comprises: (i) a collision energy of said parent ions; (ii) an ion-ion interaction or residence time; (iii) an ion-electron interaction or residence time; (iv) an ion-charged particle interaction or residence time; (v) an ion-neutral particle interaction or residence time; (vi) a reagent ion concentration; or (vii) an energy or density of an electron beam or other beam of charged particles.

9. A mass spectrometer comprising:

an ion source arranged and adapted to generate a plurality of species of parent ions to form a precursor ion beam;

a device arranged and adapted to encode said precursor ion beam by varying a parameter between a plurality of different parameter values so that different species of parent ions are caused to have different intensity profiles as a function of said parameter value or as a function of time, wherein said device is arranged and adapted to vary said parameter between at least 3 different parameter values;

a mass analyser arranged and adapted to determine said encoding by measuring the precursor ions and interrogating precursor ion spectra;

a mass analyser arranged and adapted at each parameter value to mass analyse any product ions which are derived from said parent ions; and a device arranged and adapted to correlate or assign product ions with corresponding parent ions based on the intensity profile of said product ions as a function of said parameter value or as a function of time and the intensity profiles of said parent ions as a function of said parameter value or as a function of time, wherein said parameter comprises: (i) a collision energy of said parent ions; (ii) an ion-ion interaction or residence time; (iii) an ion-electron interaction or residence time; (iv) an ion-charged particle interaction or residence time; (v) an ion-neutral particle interaction or residence time; (vi) a reagent ion concentration; or (vii) an energy or density of an electron beam or other beam of charged particles.

10. A mass spectrometer comprising:

an ion source arranged and adapted to generate a plurality of species of parent ions to form a precursor ion beam;

a device arranged and adapted to encode said precursor ion beam by varying a parameter between a plurality of different parameter values so that different species of parent ions are caused to have different intensity profiles as a function of said parameter value or as a function of time, wherein said device is arranged and adapted to vary said parameter between at least 3 different parameter values;

a mass analyser arranged and adapted to determine said encoding by measuring the precursor ions and interrogating precursor ion spectra;

a mass analyser arranged and adapted at each parameter value to mass analyse any product ions which are derived from said parent ions; and a device arranged and adapted to correlate or assign first product ions with second product ions based on the intensity profile of said first product ions as a function of said parameter value or as a function of time and the intensity profile of said second product ions as a function of said parameter value or as a function of time, wherein said parameter comprises: (i) a collision energy of said parent ions; (ii) an ion-ion interaction or residence time; (iii) an ion-electron interaction or residence time; (iv) an ion-charged particle interaction or residence time; (v) an ion-neutral particle interaction or residence time; (vi) a reagent ion concentration; or (vii) an energy or density of an electron beam or other beam of charged particles.

* * * * *